US012553232B2

(12) United States Patent
Shin et al.

(10) Patent No.: US 12,553,232 B2
(45) Date of Patent: Feb. 17, 2026

(54) MULTI-STAGE CAMPING HOUSE

(71) Applicants: Youn Ho Shin, Daegu (KR); Won Su Shin, Daegu (KR)

(72) Inventors: Youn Ho Shin, Daegu (KR); Won Su Shin, Daegu (KR)

( * ) Notice: Subject to any disclaimer, the term of this patent is extended or adjusted under 35 U.S.C. 154(b) by 149 days.

(21) Appl. No.: 18/691,217

(22) PCT Filed: Jul. 20, 2022

(86) PCT No.: PCT/KR2022/010649
§ 371 (c)(1),
(2) Date: Mar. 12, 2024

(87) PCT Pub. No.: WO2023/075091
PCT Pub. Date: May 4, 2023

(65) Prior Publication Data

US 2024/0401325 A1 Dec. 5, 2024

(30) Foreign Application Priority Data

Oct. 28, 2021 (KR) ..... 10-2021-0145349

(51) Int. Cl.
*E04B 1/343* (2006.01)
*E04B 1/344* (2006.01)

(52) U.S. Cl.
CPC ..... *E04B 1/34384* (2013.01); *E04B 1/3431* (2013.01); *E04B 1/3444* (2013.01)

(58) Field of Classification Search
CPC .... E04B 1/343; E04B 1/3431; E04B 1/34384; E04B 1/34305; E04B 1/34312;
(Continued)

(56) References Cited

U.S. PATENT DOCUMENTS 2,842,806 A * 7/1958 Tomassini ..... E04B 1/3449 52/261
2,920,920 A * 1/1960 Couse ..... B60P 3/34 296/26.02

(Continued)

FOREIGN PATENT DOCUMENTS

JP H05-18008 A 1/1993
JP H10-317497 A 12/1998

(Continued)

OTHER PUBLICATIONS

English Specification of 10-2197713.

(Continued)

*Primary Examiner* — Jessica L Laux
(74) *Attorney, Agent, or Firm* — ANTONIO HA & U.S. PATENT, LLC

(57) ABSTRACT

The present invention relates to a camping house having an expandable camping space and, more specifically, to a multi-stage camping house capable of expanding a living space by withdrawing an auxiliary chamber that is in a main chamber in which the living space is formed, and coupling an auxiliary support supporting the auxiliary chamber to a main support supporting the main chamber to be foldable, and thus, the volume can be minimized so as to improve convenience in transportation, and installation of the multi-stage camping house can be carried out simply.

10 Claims, 12 Drawing Sheets

(58) Field of Classification Search
CPC .... E04B 1/34317; E04B 1/344; E04B 1/3444; E04B 1/3442; E04B 1/348; E04H 1/02; E04H 1/1205
See application file for complete search history.

(56) References Cited

U.S. PATENT DOCUMENTS 3,325,206 A * 6/1967 Carlson ..... B60P 3/341 135/904
3,352,312 A * 11/1967 Martin ..... E04H 15/06 135/132
5,152,109 A * 10/1992 Boers ..... E04H 3/24 296/26.02
5,185,973 A * 2/1993 Oldani ..... E04H 3/08 52/64
5,461,832 A * 10/1995 Smith ..... E04B 1/3444 52/143
5,642,589 A * 7/1997 Miron ..... E04H 12/182 52/118
5,660,000 A * 8/1997 Macintyre ..... E04H 3/126 52/9
5,716,090 A * 2/1998 Chang ..... B60P 3/0252 52/66
5,732,893 A * 3/1998 Nied ..... B02C 19/068 241/39
6,393,769 B1 * 5/2002 Mertik ..... E04H 3/28 296/26.14
6,708,454 B1 * 3/2004 Frerichs ..... B60P 3/34 403/65
8,166,715 B2 * 5/2012 De Azambuja .... B65D 90/0006 52/79.5
8,978,311 B1 * 3/2015 Uhl ..... E04B 1/34336 52/79.5
10,219,447 B1 * 3/2019 DeCarli ..... E04B 1/3442
11,066,003 B1 * 7/2021 Condie ..... E04H 1/1205
11,242,691 B2 * 2/2022 Williams ..... E04H 3/30
11,292,379 B2 * 4/2022 Wilson, Sr. ..... B60J 7/08
2005/0160682 A1 * 7/2005 Quadrio ..... B65D 90/14 52/67
2013/0305626 A1 * 11/2013 Strickland ..... E04B 1/3444 52/79.5
2014/0150352 A1 * 6/2014 Lee ..... E04B 1/3444 52/79.5

FOREIGN PATENT DOCUMENTS

KR 10-1637960 7/2016
KR 10-2046342 11/2019
KR 10-2189646 12/2020
KR 10-2197713 12/2020
KR 10-2279665 7/2021

OTHER PUBLICATIONS

English Specification of 10-2279665.
English Specification of 10-1637960.
English Specification of 10-2189646.
English Specification of JPH10-317497A.
English Specification of JPH05-18008A.
English Specification of 10-2046342.

* cited by examiner

MULTI-STAGE CAMPING HOUSE

TECHNICAL FIELD

The present invention relates to a camping house with expanded camping space, and more specifically, to a multi-stage camping house in which an auxiliary chamber is pulled out from inside the main chamber where the camping space is formed to expand the camping space, and an auxiliary support supporting the auxiliary chamber is folded and combined with a main support supporting the main chamber, thereby minimizing volume, improving ease of movement, and being capable of being easily installed.

BACKGROUND ART

In general, as the living environment of modern people becomes increasingly more relaxed, living standards improve, and leisure time increases, more and more people are leaving the city and traveling to enjoy leisure outdoors such as rivers, mountains, and fields.

However, because there are no lodging facilities at the destination, it is difficult to use due to crowds, and the fees are high, the number of people who travel with camping supplies as an alternative is increasing.

Camping causes enjoy of free travel regardless of location without being restricted by accommodations to live outdoors with lodging and meals, and in camping, a tent is set up or a camping house equipped with various living facilities such as a kitchen and bedroom is mounted on a mobile frame such as a truck or trailer and moved.

The camping house is divided into camping cars that can be driven on their own and caravans that are towed and moved by a driving body, depending on the presence or absence of moving power.

The interior of the camping house is equipped with facilities such as beds, sofas, storage cabinets, kitchens, and toilets to enable daily life, and these facilities have the advantage of being movable.

However, on the other side of the advantage that living facilities can be moved, there is a disadvantage that the size of the camping house cannot exceed a certain size in order to protect the camping house from obstacles and various facilities installed on the road during movement so that it is not possible to create a leisurely space, which causes the inconvenience of reducing the movement line available for living in the camping house.

As a solution to this problem, the problem of narrow internal space can be solved by extending the length of the camping house like a trailer, but this method leads to increased manufacturing costs and difficulties in driving the vehicle.

Further, although the actual purchase price and maintenance cost of the camping house is high, the frequency of use is inevitably limited, so despite the convenience, there is a problem in that it is a financial burden for individuals to purchase and use it.

Further, the accommodation space is limited according to the shape manufactured when the camping house was first manufactured, and therefore, expansion to install additional convenience facilities is impossible after manufacturing, making it impossible to lead a comfortable camping life.

Therefore, in order to solve this problem, by overcoming the disadvantage of having to create a limited space in accordance with the characteristics of movement, it is installed so that the internal space can be expanded at the camping site, allowing for a more convenient camping life, and the development of camping houses that simplify the configuration, lower production costs, and lower the barriers to camping life is emerging.

PRIOR ART LITERATURE

Patent Document (Patent Document 1) KR 10-2197713 (B1) (2020.12.24)
(Patent Document 2) KR 10-2279665 (B1) (2021.07.14)

DISCLOSURE

Technical Problem

In order to address the above issues, an object of the present invention is to provide a multi-stage camping house for expanding the camping space by drawing the auxiliary chamber to the outside from inside the main chamber forming the camping space and combining and folding the auxiliary support supporting the auxiliary chamber with the main support supporting the main chamber using a rotating hinge, so that when moving the camping house to the camping site, convenience of movement is improved by minimizing the volume, and when installing at the camping site, the auxiliary support is rotated downward and the auxiliary chamber is pulled out, making it easy to install and allowing comfortable camping in a wide camping space.

Another object of the present invention is to provide a multi-stage camping house for folding and connecting an extension support to the end of an auxiliary support by an extension hinge to support the auxiliary chamber, thereby lowering the length of the extension support below the height of the main chamber, to allow it to be conveniently moved without the risk of getting caught in the structure and mounting the fixing protrusion of the extension support in the support fixing groove of the fixing column so that the extension support and the auxiliary support can be fixed together in a folded state.

Still another object of the present invention is to provide a multi-stage camping house for raising and opening the eaves forming the side walls of the auxiliary chamber to allow the extension floor provided on the inside of the eaves to form an additional bottom surface, thereby improving the sense of openness of the auxiliary chamber to increase the quality of camping and lowering the height of the extension floor than the eaves window, so it is not blocked to reduce stuffy.

Yet another object of the present invention is to provide a multi-stage camping house for moving up and down the roof provided at the top of the main chamber along the elevating column to form the upper space by the floor of the main chamber and the wall of a different floor height and lifting all the elevating columns together by the chain coupled to the lower part of the elevating column as the single rotating shaft provided on one side of the main chamber rotates thereby easily operating movement up and down of the roof.

Further another object of the present invention is to provide a multi-stage camping house for, as the elevating column rises, lifting the upper and lower elevators moving up and down along the elevating groove of the fixing column to a certain height while maintaining the gap so that the ribs provided at the upper and lower elevators are formed, thereby preventing the risk of falling for occupants in the upper space of the layer wall.

Technical Solution

To achieve the above purpose, the present invention provides a multi-stage camping house, comprising: a main chamber (100) configured to form a camping space in a hollow interior thereof, to be supported by a vertically arranged fixing column (110), to be provided with a roof (140) that is lifted up and down by an elevating column (120) provided inside the fixing column (110) at a upper part thereof, and to be provided with a bed frame (130) that folds vertically or horizontally on both sides thereof; and an auxiliary chamber (200) configured to expand the camping space while being drawn out from the inside to the outside the main chamber (100), to be provided with a hollow interior communicating with an inner space of the main chamber (100) and which is provided with a chamber wheel (210) for movement at a bottom thereof; wherein the fixing column (110) has a vertical elevating groove (111) and a fall prevention bar (112) that is in contact with a protrusion (121) formed in the lower part of the elevating column (120) and moving up and down along the elevating groove (111) to prevent downward movement of the elevating column (120), wherein an upper railing (126) and a lower railing (124) that slide up and down along the longitudinal direction of the elevating column (120) are provided on the outer surface of the elevating column (120), wherein a plurality of spokes (127) connected to the upper railing (126) and the lower railing (124) provided on another adjacent elevator column (120) are attached to the upper railing (126) and the lower railing (124); wherein the elevator column (120) is provided and protruded with an upper elevator (123) that contacts the upper railing (126) to raise and lower the upper railing (126), and a lower elevator (124) that contacts the lower railing (124) to raise and lower the lower railing (124), and wherein the lower railing (124) has a space separated for the upper elevator (123) to pass through.

Further, in the present invention, the multi-stage camping house comprises a main support (500) being disposed at the lower part of the main chamber (100), having a rail surface in contact with the chamber wheel (210), being located inside the fixing column (110), and having a hinge (510) coupled to the outer surface of an end thereof; and an auxiliary support (400) supporting the auxiliary chamber (200) from the bottom, having a rail surface in contact with the chamber wheel (210), and having a rotation hinge (410) coupled to rotate on the hinge (510).

Further, in the present invention, an extension support (420) supports the auxiliary chamber (200) from the lower part thereof, is folded at the end of the auxiliary support (400) by an extension hinge (421), and has a fixing protrusion (422) protruding outward at a upper part thereof, and the auxiliary support (400), and the extension support (420) are fixed in a vertically folded state while the fixing protrusion (422) is inserted into the support fixing groove (113) formed on the fixing column (110).

Further, in the present invention, the rotation hinge (410) of the auxiliary support (400) is formed to be round, and when the auxiliary support (400) is unfolded horizontally, a rail surface of the main support (500) and a rail surface of the auxiliary support (400) are formed at the same height.

Further, in the present invention, the auxiliary chamber (200) has an extended floor (230) that extends to the outside of the auxiliary chamber (200) to form a bottom surface and is provided on the inside of the eaves (220) forming a side wall of the auxiliary chamber (200), and wherein the extended floor (230) includes a floor wheel (231) that rolls on a floor rail (240) formed in the lower part of the auxiliary chamber (200); and a folding plate (233) that is folded and connected to the extended floor (230) by a floor hinge (234) to form a bottom surface.

Further, in the present invention, a stopper (232) formed on the floor wheel (231) is hung on a stop stand (250) formed higher than the height of the floor rail (240) so that the extended floor (230) is fixed in the unfolded state.

Further, in the present invention, a bottom surface of the extended floor (230) in the unfolded state is formed at the same height as a bottom surface of the auxiliary chamber (200), and the height when the folding plate (233) and the extended floor (230) are folded is lower than the height of a window (221) provided in the eaves (220).

Further, in the present invention, the main chamber (100) is provided with a single rotating shaft (300) on one side, in which a pair of first sprocket wheels (310) arranged in a horizontal direction are formed and a pair of second sprocket wheels (320) are formed outside the first sprocket wheels (310), and wherein a protrusion (121) on which a chain (330) engaged with the first sprocket wheels (310) or the second sprocket wheels (320) is fixed is formed at a lower part of the elevating column (120), Further, in the present invention, the plurality of spokes (127) respectively attached to the upper railing (126) and the lower railing (124) are arranged vertically.

Further, in the present invention, a gap between the upper rail (126) and the lower rail (124) becomes the same as a gap between the upper elevator (123) and the lower elevator (122) when the elevatoring column (120) rises.

Advantageous Effects

The multi-stage camping house of the present invention has the advantage of expanding the camping space by drawing the auxiliary chamber to the outside from inside the main chamber forming the camping space and combining and folding the auxiliary support supporting the auxiliary chamber with the main support supporting the main chamber using a rotating hinge, so that when moving the camping house to the camping site, convenience of movement is improved by minimizing the volume, and when installing at the camping site, the auxiliary support is rotated downward and the auxiliary chamber is pulled out, making it easy to install and allowing comfortable camping in a wide camping space.

The present invention has the advantage of folding and connecting an extension support to the end of an auxiliary support by an extension hinge to support the auxiliary chamber, thereby lowering the length of the extension support below the height of the main chamber, to allow it to be conveniently moved without the risk of getting caught in the structure and mounting the fixing protrusion of the extension support in the support fixing groove of the fixing column so that the extension support and the auxiliary support can be fixed together in a folded state.

The present invention has the advantage of raising and opening the eaves forming the side walls of the auxiliary chamber to allow the extension floor provided on the inside of the eaves to form an additional bottom surface, thereby improving the sense of openness of the auxiliary chamber to increase the quality of camping and lowering the height of the extension floor than the eaves window, so it is not blocked to reduce stuffy.

The present invention has the advantage of moving up and down the roof provided at the top of the main chamber along the elevating column to form the upper space by the floor of the main chamber and the wall of a different floor height and lifting all the elevating columns together by the chain coupled to the lower part of the elevating column as the single rotating shaft provided on one side of the main chamber rotates thereby easily operating movement up and down of the roof.

The present invention has the advantage of, as the elevating column rises, lifting the upper and lower elevators moving up and down along the elevating groove of the fixing column to a certain height while maintaining the gap so that the ribs provided at the upper and lower elevators are formed, thereby preventing the risk of falling for occupants in the upper space of the layer wall.

MODE FOR INVENTION

Figure 1:
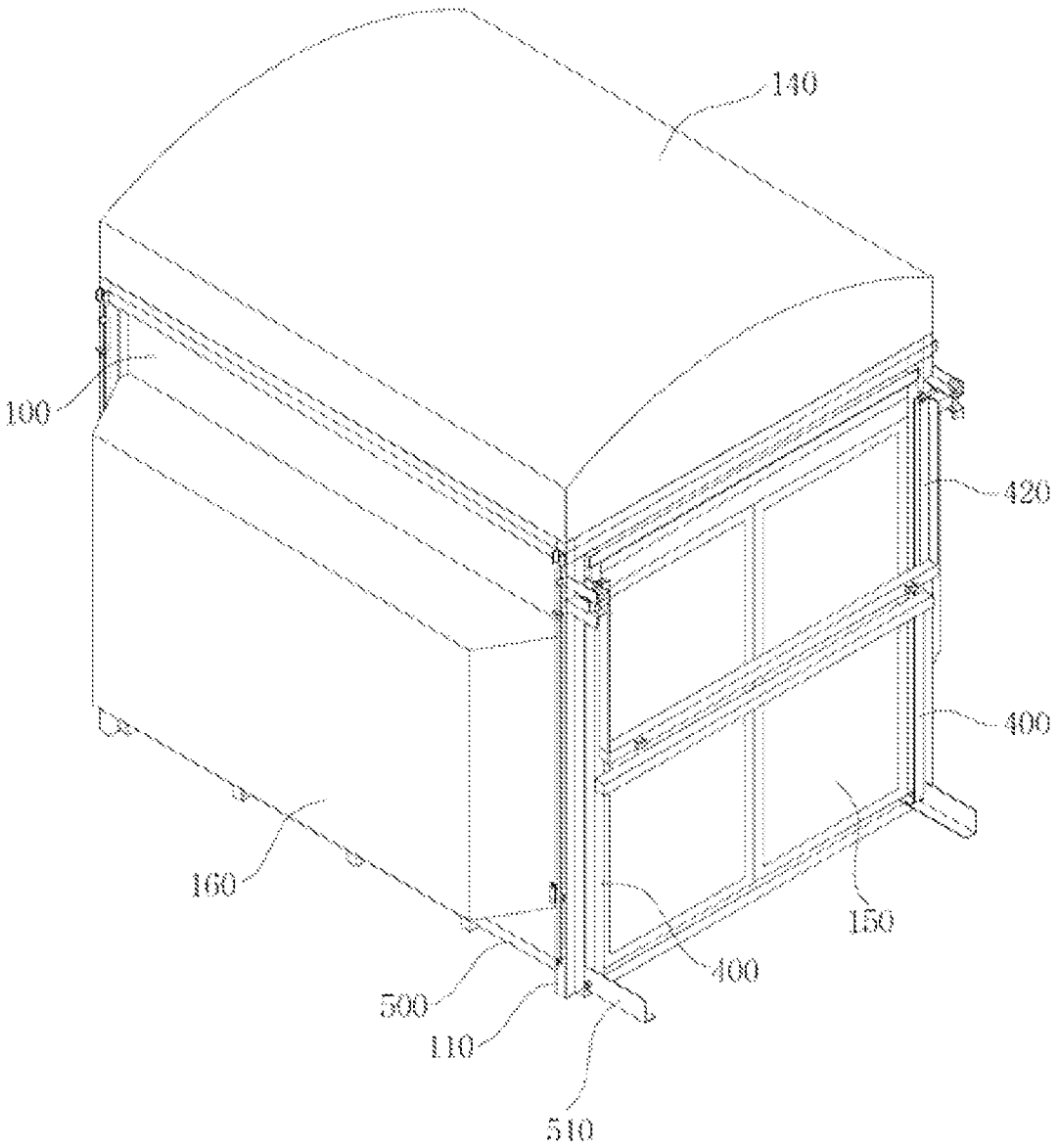
FIG. 1 is a perspective view of the auxiliary chamber according to the multi-stage camping house of the present invention inserted into the main chamber.
Figure 2:
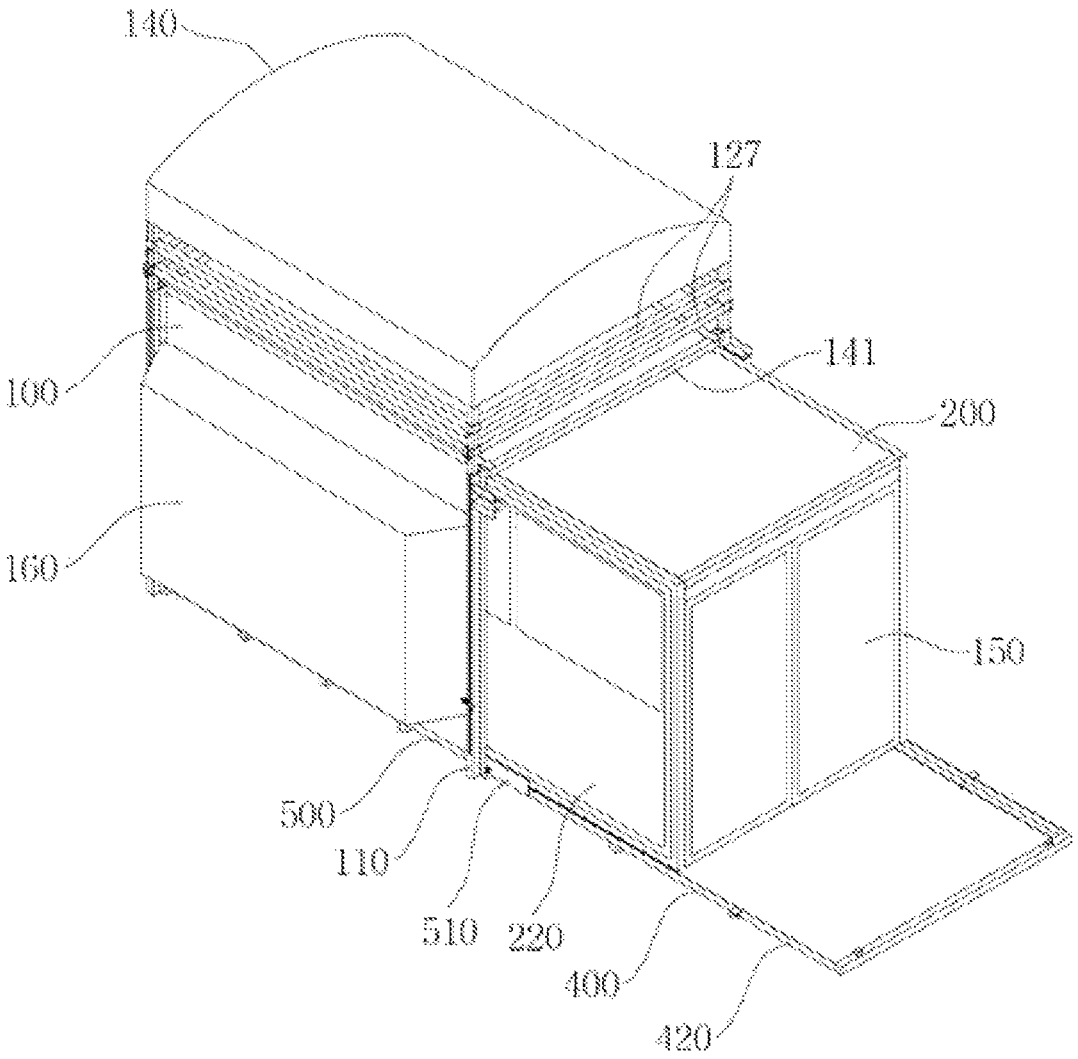
FIG. 2 is a perspective view of the auxiliary chamber according to the multi-stage camping house of the present invention pulled out the main chamber.
Figure 3:
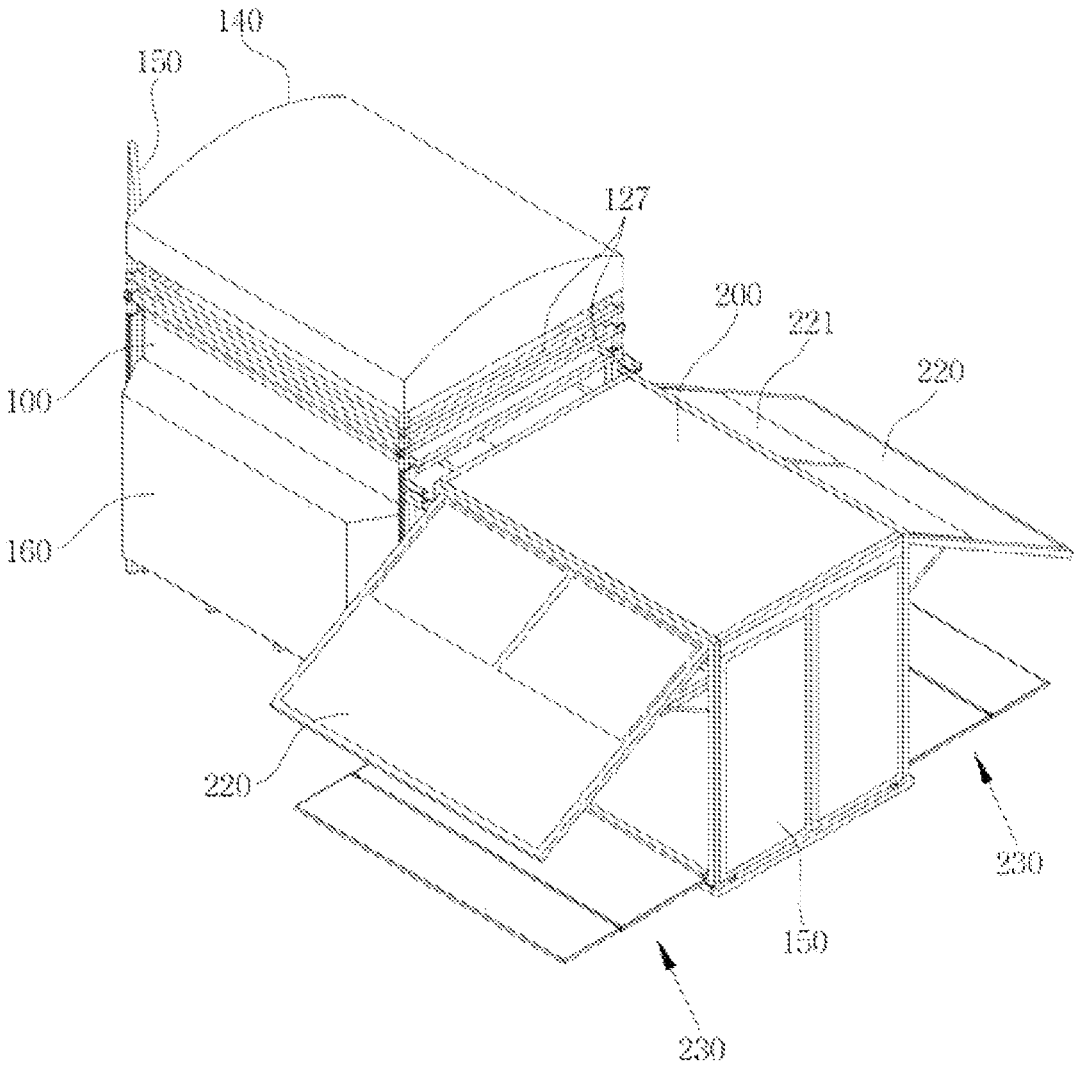
FIG. 3 is a perspective view of the multi-level camping house according to the present invention with the eaves and extended floors spread out.
Figure 4:
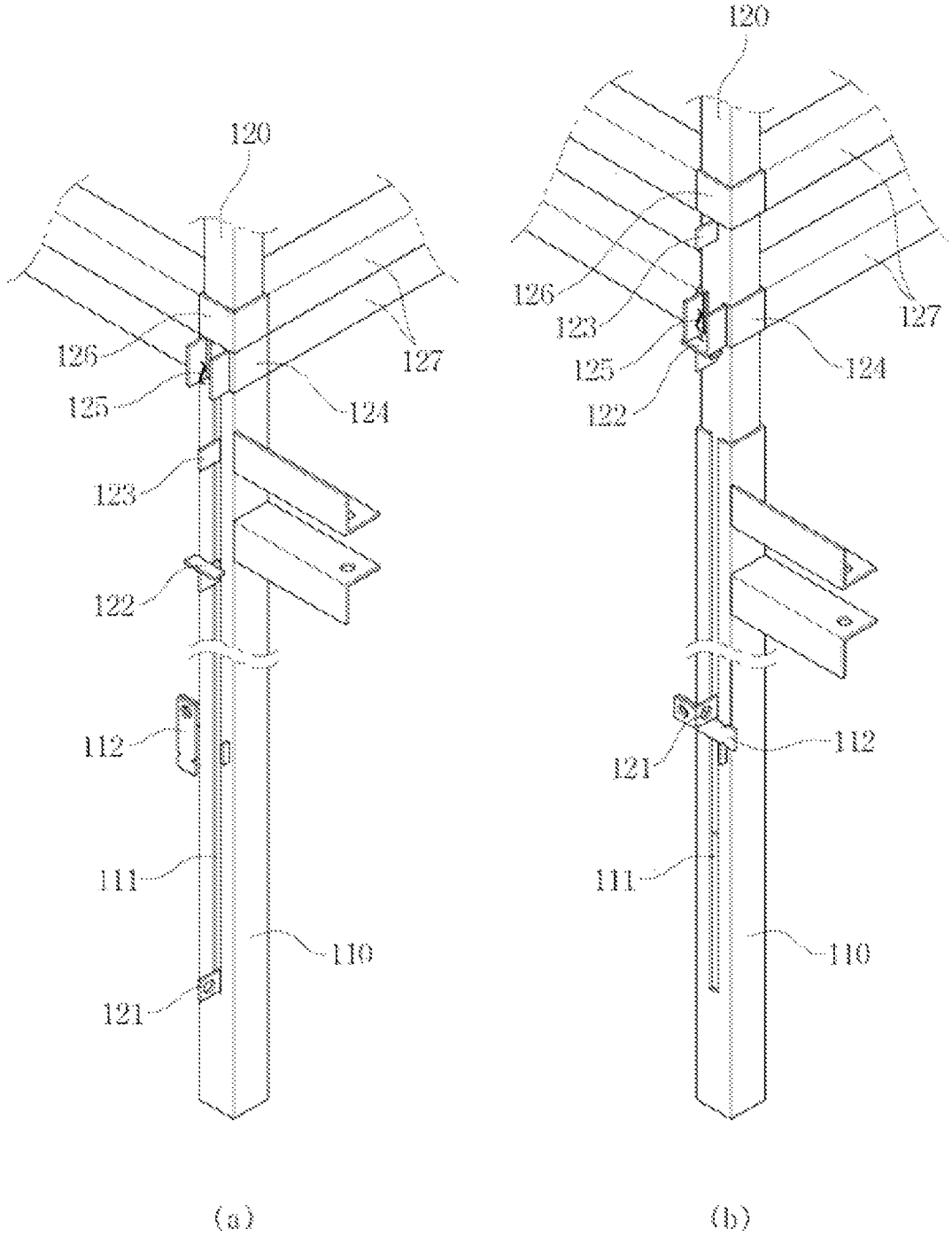
FIG. 4 shows the fixing column and the elevating column according to the multi-stage camping house of the present invention, in which FIG. 4(*a*) is a perspective view before the elevating column is raised, and FIG. 4(*b*) is a perspective view with the elevating column raised.
Figure 5:
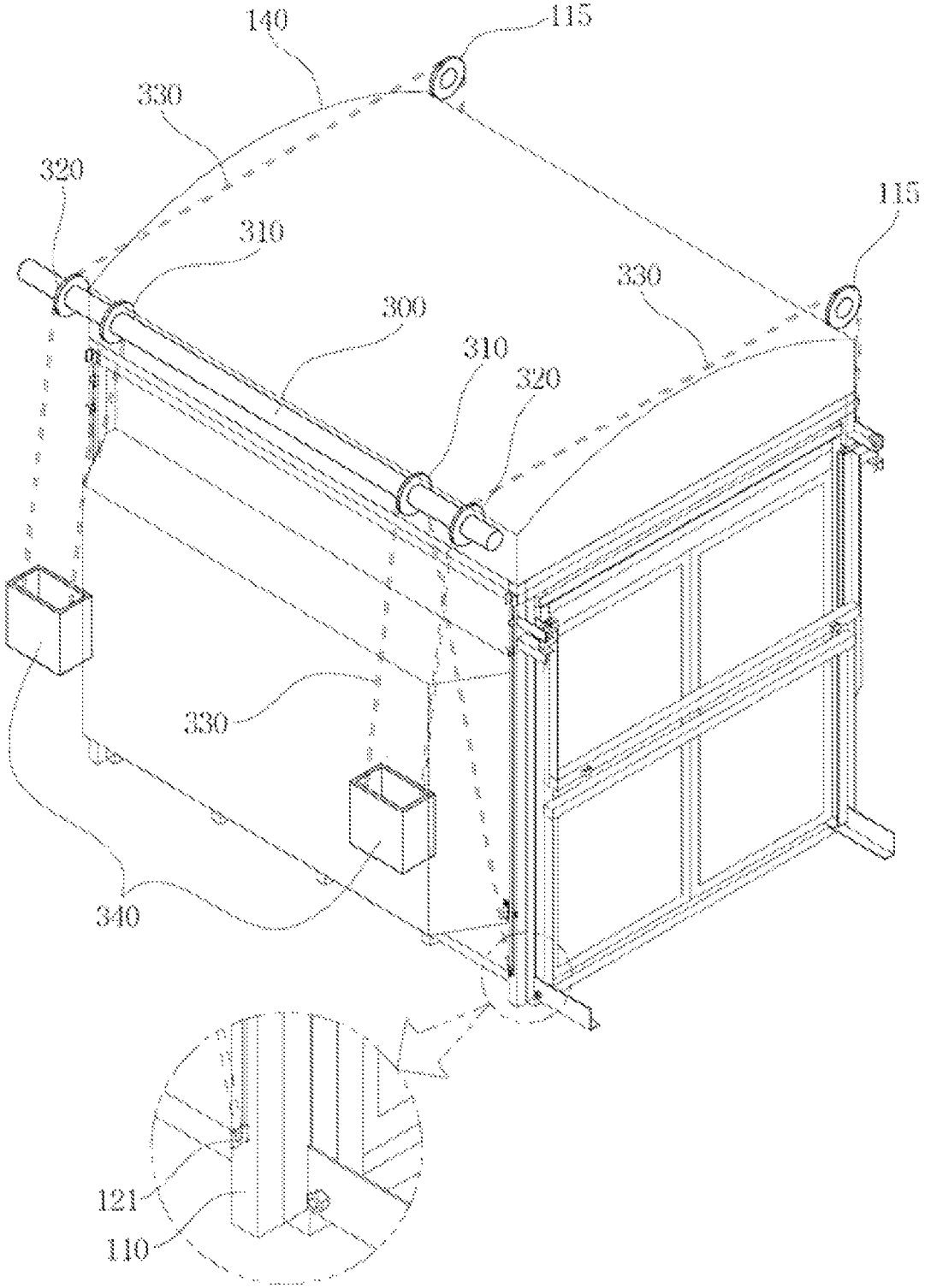
FIG. 5 is a perspective view showing the coupling of the chain with the rotating shaft and the protrusion of an embodiment in which the elevating column according to the multi-stage camping house of the present invention is manually raised.
Figure 6:
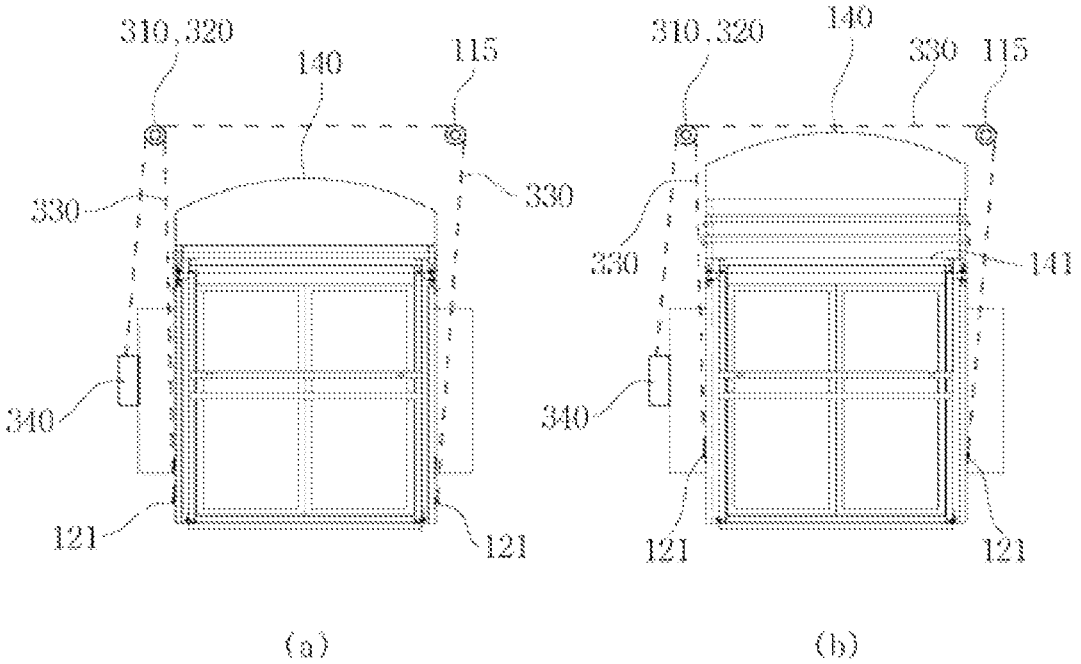
FIG. 6 shows an embodiment in which the elevating column according to the multi-stage camping house of the present invention is manually raised, in which FIG. 6(*a*) is a front view in a state before the elevating column is raised, and FIG. 6(*b*) is a front view in a state in which the elevating column is raised.
Figure 7:
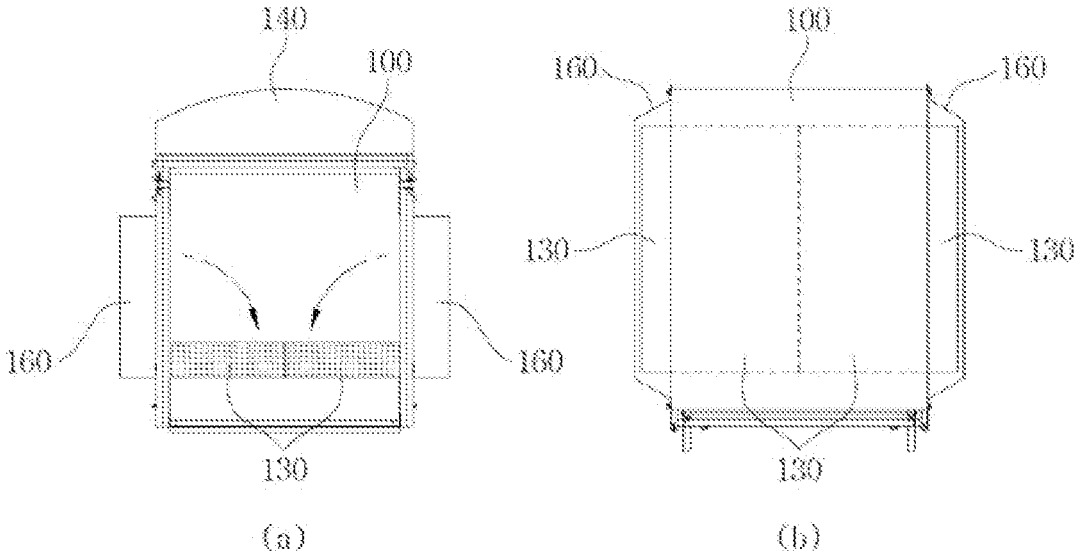
FIG. 7 shows a bed frame according to the multi-stage camping house of the present invention, (a) is a front view showing the operation of the bed frame, and (b) is a plan view showing the operation of the bed frame.

Hereinafter, a preferred embodiment of the present invention is described with reference to the accompanying drawings so that those skilled in the art can easily implement it.

In the present invention, the front refers to the direction in which the auxiliary chamber (200) is pulled out from the main chamber (100), and the rear refers to the direction opposite to the direction in which the auxiliary chamber (200) is pulled out from the main chamber (100).

As shown in FIGS. 1 to 13, the multi-stage camping house according to the present invention is a camping house expanded into multiple stages, and the camping house expanded into multiple stages includes a main chamber (100) configured to form a camping space in a hollow interior thereof, to be supported by a vertically arranged fixing column (110), to be provided with a roof (140) that is lifted up and down by an elevating column (120) provided inside the fixing column (110) at a upper part thereof, and to be provided with a bed frame (130) that folds vertically or horizontally on both sides thereof; and an auxiliary chamber (200) configured to expand the camping space while being pulled out from the inside to the outside the main chamber (100), to be provided with a hollow interior communicating with an inner space of the main chamber (100) and which is provided with a chamber wheel (210) for movement at a bottom thereof.

The multi-stage camping house according to the present invention is intended to provide a camping house that can provide lodging and food at a camping site and is coupled to a moving frame such as a vehicle or caravan to generate power itself or receives power from outside to move to the camping site, and at the arrived camping site, the multi-stage camping house of the present invention is installed to form an occupational space, and then camping is carried out.

The multi-level camping house of the present invention is mounted on a mobile frame, and when moving, the components that make up the camping house are fixed inside in a folded state to minimize the volume, thereby avoiding getting caught and damaged by obstacles such as trees and road signs that exist in the process of moving to the camping site. Therefore, the camping house of the present invention is convenient to move, and the transportation process can be made easy.

When arriving at a camping site and setting up a camping house, the camping space is expanded by pulling out and expanding the components that make up the camping house stored inside. Considering the convenience of operation when transporting, the camping house is designed with minimal volume and can be expanded to secure better camping space to enjoy a comfortable camping life due to the advantages of being equipped with many camping supplies and expanding the internal living space to expand the movement line.

The multi-stage camping house according to the present invention can be expanded by forming a plurality of internal camping spaces and communicating with them to each other.

The present invention is provided with a main chamber (100) that is arranged on the outermost side of a camping house to form an external shape, and an auxiliary chamber (200) that can be drawn out from inside to the outside the main chamber (100). The auxiliary chamber (200) is inserted and fixed into the main chamber (100) when the camping house is moved, thereby minimizing the volume. but the auxiliary chamber (200) is pulled out of the main chamber (100) when installed at a camping site, so that the camping space inside the main chamber (100) and the camping space inside the auxiliary chamber (200) are communicated to allow coming and going, thereby allowing for a wide camping space so that a comfortable camping life is possible.

The main support (500) disposed below the main chamber (100) supports the main chamber (100) from the ground and forms a rigid framework to improve structural stability. The end of the main support (500) and the auxiliary support (400) supporting the auxiliary chamber (200) are folded and coupled. The auxiliary support (400) is folded vertically or horizontally, so that when the camping house is moved, it is fixed in a vertically folded state, preventing the auxiliary chamber (200) from being pulled out to the outside while minimizing its volume, and when installed at a camping site, it is spread horizontally to form a frame that can support the auxiliary chamber (200), stably supporting the auxiliary chamber (200).

The rail surface of the auxiliary support (400) is connected to the rail surface of the main support (500) without any steps, so that when the auxiliary chamber (200) is pulled out, it can be installed smoothly and easily without jamming, and it can also be folded vertically to promote convenience of transportation.

As shown in FIGS. 1 to 7, the multi-level camping house according to the present invention is provided with the main chamber (100) that is placed at the outermost side to form an external shape. The main chamber (100) has a hollow interior to form a camping space. Items needed for camping can be stored inside.

The main chamber (100) may be formed in a box shape, and the front may be opened to allow the auxiliary chamber (200) to be pulled out. When the auxiliary chamber (200) is pulled out, the inner space of the auxiliary chamber (200) and the inner space of the main chamber (100) are communicated through the open front to allow freely coming and going.

The front of the main chamber (100) may be fully or partially open depending on the size of the auxiliary chamber (200).

The rear of the main chamber (100) is provided with an entrance door (150) for access to the internal camping space. The entrance door (150) may be formed on one side, but in one embodiment of the present invention, it is shown as being formed on the rear. It is preferable that the main chamber (100) rotates outward to prevent camping equipment and the auxiliary chamber (200) from being caught in the inner space, but the entrance door (150) can be opened and closed even with a structure such as a sliding door.

A roof (140) is provided at the top of the main chamber (100). The roof (140) is coupled to the upper part of the elevating column (120), which will be described later, and is raised and lowered together as the elevating column (120) rises up and descends. When the roof (140) rises, the upper space of the main chamber (100) is formed as an attic-like space by the layer wall (141) that forms a floor height different from the bottom surface of the main chamber (100), so campers can stay there.

The layer wall (141) is disposed in the horizontal direction at the upper part of the main chamber (100) and is spaced apart from the bottom surface of the main chamber (100). In order to comfortably create the inner space of the main chamber (100), the height of the layer wall (141) is preferably formed to be higher than the height of the camper, but may be adjusted in consideration of the overall volume of the main chamber (100).

The layer wall (141) is configured to divide the space of the main chamber (100), and an interior is formed below the layer wall (141) and a space that communicates with the outside is formed above the layer wall (141), giving a sense of openness like an attic.

For the safety of occupants staying in the space above the layer wall (141), when the roof (140) rises, a handrail is formed to prevent a fall.

A fixing column (110) in the shape of a square tube supporting the main chamber (100) is provided perpendicularly to the edge of the main chamber (100). The fixing column (110) is disposed on the outside of the main support (500), which will be described later, to maintain the external shape of the main chamber (100), and even if a load is applied to the space above the roof (140), which will be described later, it is supported, and the load is transmitted to the ground.

The interior of the fixing column (110) is hollow, and the elevating column (120), which will be described later, is provided in the hollow interior to rise and drop. The fixing column (110) may be provided with an idle wheel (115) for simultaneously raising and lowering the elevating column (120). One side of the main chamber (100) may be provided with the single rotation shaft (300), which will be described later, arranged horizontally in the front and rear direction, and the idle wheel (115) connected to the rotation shaft (300) and the chain (330) is provided on the other side of the main chamber (100) that is not equipped with the rotation shaft (300). The idle wheel (115) may be provided on the upper part of the fixing column (110). However, the position of the idle wheel (115) is not limited to this, and it is sufficient if it can be located above the protrusion (121).

On one side of the fixing column (110), a vertically long elevating groove (111) is formed. The elevating groove (111) is formed to the upper end of the fixing column (110) so the upper part is open, but is not formed to the lower end of the fixing column (110) to be closed. It is formed at a certain distance from the lower end of the fixing column (110) to the upper part, and continues to the upper end while being formed in a vertical direction.

For the elevating groove (111), the upper and lower elevators and protrusions (121) of the elevating column (120) are exposed to the outside, and the protrusion (121) located at the lower part is caught at the lower end of the elevating groove (111) to prevent the elevating column (120) from lowering any further.

The elevating column (120), which is inserted into the interior of the fixing column (110) and moves up and down, is configured to raise and lower the roof (140) and is coupled to the roof (140) at the upper part.

As the elevating column (120) rises, the roof (140) also rises to form an attic space in the upper part of the main chamber (100), and when the elevating column (120) lowers, the roof (140) also lowers.

The outer surface of the elevating column (120) is provided with an upper railing (126) and a lower railing (124) that form a handrail to prevent falls in the upper space of the main chamber (100). The upper and lower railings are each formed with spokes (127) and are coupled to the upper and lower railings provided on another adjacent elevating column (120). That is, the spork (127) is connected to the neighboring upper and lower railings. Therefore, the spork (127) forms a handrail along the edge of the upper space of the main chamber (100) to prevent the occupant from falling.

The sporks (127) are attached to the upper railing (126) and the lower railing (124), respectively and are arranged perpendicular to each other.

The upper railing (126) and lower railing (124) move independently of each other. The lower railing (124) has a central groove (125) formed on one side that communicates with the elevating groove (111) of the fixing column (110), and the upper railing (126) is closed on all sides without any open portions. That is, the lower railing (124) has a separate space through which the upper elevating elevator (123) passes.

When the elevating column (120) is not raised inside the fixing column (110), the upper and lower railings are in contact with each other, and when the elevating column (120) rises, the gap between them widens to form a handrail.

The elevating column (120) is formed with the upper elevator (123) and the lower elevator (122) that contact the upper and lower handrails and pass through the elevating groove (111). Then the upper elevator (123) raises and lowers the upper railing (126), and the lower elevator (122) raises and lowers the lower railing (124).

The upper elevator (123) protrudes through the elevating groove (111) of the fixing column (110) and is formed to be thin enough to pass through the central groove (125) of the lower railing (124). When the elevating column (120) rises, the upper elevator (123) passes through the central groove (125) of the lower railing (124), contacts and pushes up the upper rail (126). That is, the interior of the lower railing (124) is separated so that the upper elevator (123). passes through it.

The lower elevator (122) is formed to have a wider width than the central groove (125) of the lower railing (124) and is in contact with the lower railing (124). According to one embodiment of the present invention, it has a 'T' shape, but it is sufficient for the lower elevator (122) to have a shape that can be in contact with the lower railing (124).

The upper and lower elevators pass and protrude through the elevating groove (111) but form a spacing between each other. The spacing between the upper and lower elevators becomes the spacing between the upper and lower railings as the elevating column (120) rises. First, the upper elevator (123) passes through the central groove (125) of the lower railing (124) and comes into contact and pushes up the upper railing (126), and as the elevating column (120) continues to rise, the lower elevator (122) comes into contact and pushes up the lower railing (124). Therefore, the spacing between the upper and lower elevators becomes the same as the spacing between the upper and lower railings.

When the elevating column (120) rises to form an upper space, a fall prevention bar (112) is provided on the fixing column (110) to avoid an accident in which the roof (140) suddenly falls for the safety of occupants.

The fall prevention bar (112) may be formed at a certain height along the vertical direction of the fixing column (110), and the position of the fall prevention bar (112) is configured to prevent the elevating column (120) from descending, so it is configured as a downward limit line.

The fall prevention bar (112) is formed at the lower part of the elevating column (120) and comes into contact with the protrusion (121) that goes up and down along the elevating groove (111), thereby preventing downward movement of the elevating column (120).

The fall prevention bar (112) is formed to cross the elevating groove (111) and is configured to prevent falling by contacting the lower railing (124) or the protrusion (121) to be described later. When the fall prevention bar (112) is open, the lower rail (124) or the protrusion (121) can freely go up and down along the elevating groove (111), and when the fall prevention bar (112) is locked, the raised lower railing (124) or protrusion (121) is caught to prevent it from falling further. Therefore, camping can be enjoyed in the upper space formed after raising the roof (140) to a certain height and locking the fall prevention bar (112) to fix the roof (140) at a certain height.

The elevating column (120) is raised and lowered within the fixing column (110) arranged at the four corners of the main chamber (100), and all elevating columns (120) must be raised and lowered to the same height at the same time. Therefore, the lifting method of the elevating column (120) may be hydraulic or manual.

When the elevating column (120) operates hydraulically, hydraulic pressure is generated from a hydraulic generator (not shown) provided inside or outside the main chamber (100), and a hydraulic pipe (not shown) connected to the hydraulic generator (not shown) is branched and continued to the lower part of each elevating column (120), so that the elevating column (120) can be hydraulically raised from the lower part.

Further, in order to manually operate the elevating column (120), a single rotation shaft (300) according to an embodiment of the present invention is provided above the main chamber (100). The rotation shaft (300) is provided on one side of the main chamber (100) and is arranged horizontally along the front and rear longitudinal directions. The rotation shaft (300) may be coupled to the fixing column (110) or the outer surface of the main chamber (100).

The rotation shaft (300) is a single configuration for simultaneously elevating all the elevating columns (120), and the protrusion (121) is formed on the lower part of the elevating column (120) to be fixedly coupled to the chain (330), and the chain (330) is moved upward to raise the elevating column (120).

The protrusion (121) may form a groove to allow the chain to pass through the groove, or it can be fixed by joining the chain with welding.

The rotation shaft (300) is provided with a sprocket wheel engaged with the chain (330). As the sprocket wheel rotates, the chain (330) moves to raise or lower the elevating column (120). The sprocket wheel consists of the first sprocket wheel (310) and the second sprocket wheel (320).

There are two sprocket wheels such as the first sprocket wheel (310) and the second sprocket wheel (320), and the second sprocket wheel (320) is provided outside the rotation shaft (300) with respect to the first sprocket wheel (310). The first sprocket wheel (310) and the second sprocket wheel (320) rotate coaxially together according to the rotation of the rotation shaft (300). Further, the first sprocket wheel (310) and the second sprocket wheel (320) are formed to have the same diameter.

The single rotation shaft (300) is provided in a horizontal direction, there are two elevating columns (120) adjacent to the rotation shaft (300) and two elevating columns (120) that are not adjacent to the rotation shaft (300). For example, if the rotation shaft (300) is disposed in the longitudinal direction front and rear on the left side of the main chamber (100) when viewed from the front of the main chamber (100), the elevating columns (120) at the front and rear on the left becomes the elevating columns (120) that is adjacent to the rotation shaft (300), but the elevating columns (120) at the front and rear on the right becomes the elevating columns (120) that is not adjacent to the rotation shaft (300).

The chain (330) coupled to the protrusion (121) of the elevating column (120) that is adjacent to the rotation shaft (300) is engaged with the first sprocket wheel (310), but the chain (330) coupled to the protrusion (121) of the elevating column (120) that is not adjacent to the rotation shaft (300) is engaged with the second sprocket wheel (320). In common, one end of the chain (330) is fixedly coupled to the protrusion (121), and the other end is stored in the chain box (340).

In the elevating column (120) that is adjacent to the rotation shaft (300), one end of the chain (330) is coupled to the protrusion (121) of the elevating column (120) and is engaged with the first sprocket wheel (310) of the rotation shaft (300), and the other end is stored in the chain box (340).

In the elevating column (120) that is not adjacent to the rotation shaft (300), one end of the chain (330) is coupled to the protrusion (121) of the elevating column (120) and is firstly engaged with the idle wheel (115) located at the upper part and secondarily engaged with the second sprocket wheel (320) of the rotation shaft (300), and the other end is stored in the chain box (340). The idle wheel (115) may be coupled to the fixing column (110) that is not adjacent to the rotation shaft (300) or to the outer surface of the main chamber (100).

Therefore, when the rotation shaft (300) rotates, the chain (330) pulls the protrusion (121) to raise all the elevating columns (120) at the same time, and the chain (330) is loaded in the chain box (340) by the rising length. When the rotation shaft (300) rotates in the opposite direction, the chain (330) loaded on the chain box (340) comes out of the chain box (340) to lower all elevating columns (120) simultaneously. At this time, the range of elevation of the elevating column (120) by rotation of the rotation shaft (300) is the same for all elevating columns (120).

Therefore, the chain (330) is coupled to both the elevating column (120) that is adjacent to the rotation shaft (300) and the elevating column (120) that is not adjacent to the rotation shaft (300), so that the elevator columns (120) may be simultaneously raised according to the rotation of the single rotation shaft (300). The rotation shaft (300) is provided as a single unit, and the chain (330) is also coupled to the elevator column (120) that is not adjacent to the rotation shaft (300) and moves in conjunction with the rotation shaft (300), thereby simultaneously raising and lowering all the elevating columns (120) so that the structure is not complicated and is economical.

Bed frames (130) are provided in a folding manner on both sides of the main chamber (100). The bed frame (130) is vertically folded to secure space inside the main chamber (100) to improve space efficiency. The bed frame (130) in a vertically folded state is stored into the wall and does not interfere with the auxiliary chamber (200). After the auxiliary chamber (200) is pulled out of the main chamber (100), the bed frame (130) can be spread horizontally to form the inside of the main chamber (100) as a bedroom space. The bed frame (130) in the unfolded state may be spaced apart from the bottom surface of the main chamber (100), and a separate stand (not shown) is provided between the bottom surface of the main chamber (100) and the bed frame (130) to support the load of the bed frame (130). A hinge (not shown) for folding may be coupled to the lower part of the bed frame (130).

When the bed frame (130) is vertically folded, an outer wall (160) to protect the bed frame (130) may be formed in the main chamber (100). The outer wall (160) becomes the outer surface of the main chamber (100), and the bed frame (130) is provided between the inner wall of the main chamber (100) and the outer wall (160).

Figure 8:
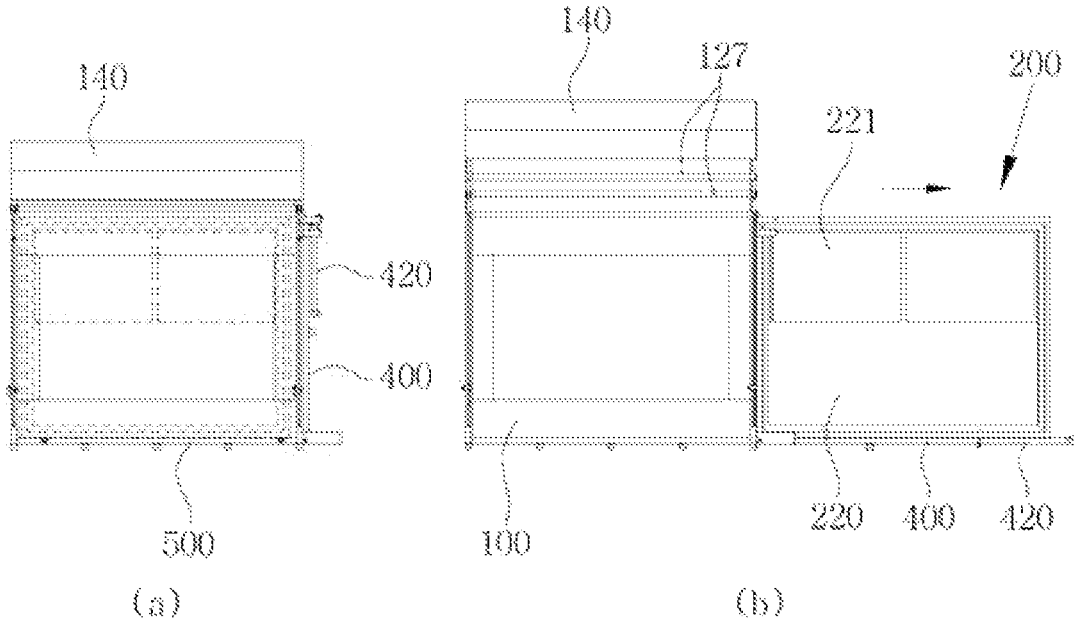
FIG. 8 shows the state in which the auxiliary chamber according to the multi-stage camping house of the present invention is pulled out, in which FIG. 8(*a*) is a side view with the auxiliary support and extension support folded, and FIG. 8(*b*) is a side view with the auxiliary support and extension support unfolded to cause the auxiliary chamber to be pulled out.
Figure 9:
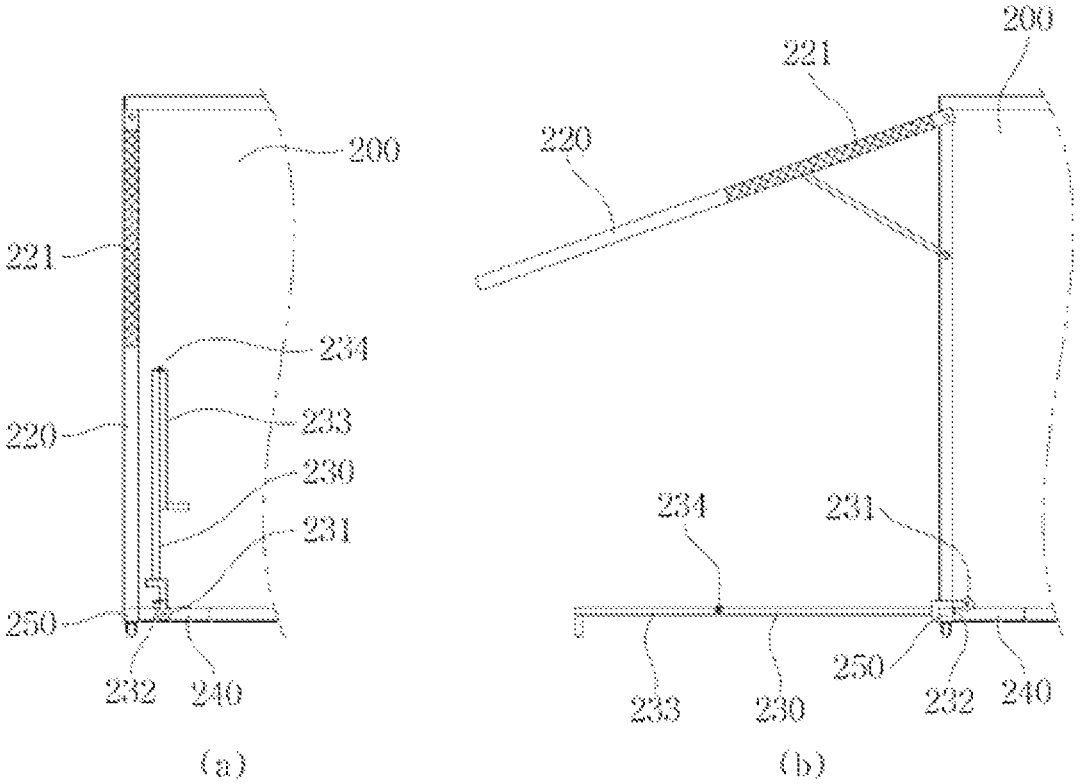
FIG. 9 shows the eaves and extended floor according to the multi-stage camping house of the present invention, in which FIG. 9(*a*) is a front view with the eaves and extended floor folded, and FIG. 9(*b*) is a front view with the eaves and extension floor unfolded.
Figure 10:
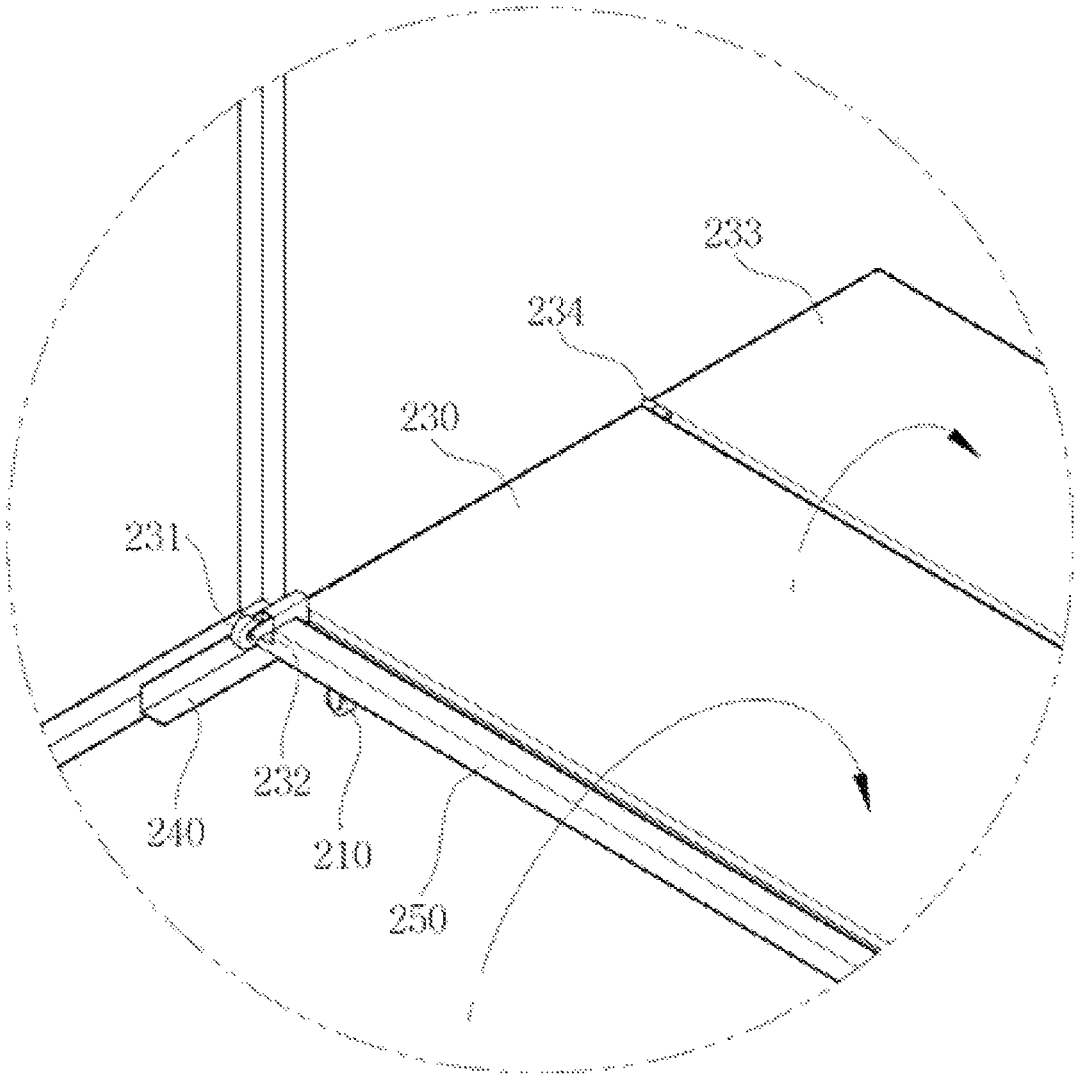
FIG. 10 is a perspective view showing the expanded floor according to the multi-level camping house of the present invention in an unfolded state.

As shown in FIGS. 8 to 10, the auxiliary chamber (200) provided inside the main chamber (100) is configured to expand the camping space of the camping house and is inserted and then pulled out the main chamber (100).

The auxiliary chamber (200) is formed in a smaller size than the main chamber (100) so that it can be inserted into the inner space of the main chamber (100), and one side is open to communicate with the inner space of the main chamber (100).

A chamber wheel (210) is provided at the lower part of the auxiliary chamber (200) to smooth insertion and withdrawal operations. The chamber wheel (210) may be pulled out or inserted into the main chamber (100) while rolling on the rail surfaces of the main support (500) and the auxiliary support (400), which will be described later.

The chamber wheel (210) has the shape of a wheel but is not limited thereto and may be formed in the shape of a rail bar that is long in the drawing direction.

Since no step is formed between the main support (500) and the auxiliary support (400), which will be described later, the chamber wheel (210) may be inserted and withdrawn smoothly.

Further, when the auxiliary support (400), which will be described later, is vertically folded, the chamber wheel (210) may be caught by the auxiliary support (400) and prevented from being pulled out.

The auxiliary chamber (200) is provided with the entrance door (150) at the front to allow entry and exit into the auxiliary chamber (200), and the entrance door (150) is also formed at the rear of the main chamber (100) so that it has a structure that faces the entrance door (150) of the auxiliary chamber (200) to receive headwinds, which is also advantageous for ventilation.

By opening the side of the auxiliary chamber (200), the openness of the internal space can be improved. The eaves (220) may have a window (221) formed at a certain height.

In the folded state, the eaves (220) form one side of the auxiliary chamber (200), and when lifted upward, the eaves (220) rotate upward and protrude to the outside of the auxiliary chamber (200) to improve the sense of openness while preventing rain.

In the folded state, the eaves (220) form the side wall of the auxiliary chamber (200), and in the unfolded state, the eaves (220) extend outward from the ceiling of the auxiliary chamber (200).

An extended floor (230) forming a bottom surface outside the auxiliary chamber (200) is provided inside the eaves (220). The extended floor (230) is provided inside the auxiliary chamber (200), but when extended to the outside, it spreads to the outside of the auxiliary chamber (200) and extends from the bottom surface of the auxiliary chamber (200) to create additional space. The eaves (220) in the unfolded state above the extended floor (230) may block snow and rain.

The extended floor (230) is provided vertically inside the auxiliary chamber (200), and the floor wheel (231) that rolls on the floor rail (240) of the auxiliary chamber (200) is provided at the lower part.

The floor rail (240) of the auxiliary chamber (200) is disposed in the direction in which the extended floor (230) is unfolded. A stop stand (250) is formed on the outer end of the floor rail (240) so that it is higher than the rail surface of the floor rail (240) to form a step. The stop stand (250) is configured to hold a stopper (232) of the floor rail (240).

The extended floor (230) rotates downward while moving to the outside of the auxiliary chamber (200) by rolling on the floor rail (240), and the stopper (232) formed on the floor wheel (231) is caught by the stop stand (250) to limit its rotation and prevent the extended floor (230) from being separated from the auxiliary chamber (200).

The extended floor (230) is provided with a folding plate (233) that may extend the bottom surface. The folding plate (233) is coupled to the extended floor (230) by a floor hinge (234), so that the folding plate (233) is folded and unfolded to form an additional bottom surface.

As the extended floor (230) is unfolded to the outside of the auxiliary chamber (200), the folding plate (233) is also unfolded, creating a large floor space.

Further the folding plate (233) assists in forming the bottom surface, the size of the extended floor (230) may be reduced. When the extended floor (230) and the folding plate (233) are folded, they may be formed at a lower height than the window (221) of the eaves (220). Accordingly, a sense of openness can be maintained by preventing the extended floor (230) provided inside the eaves (220) from blocking the windows (221) of the eaves (220).

Further, the bottom surface of the auxiliary chamber (200) and the bottom surface of the extended floor (230) are formed at the same height, so there is no step, so entry and exit from the auxiliary chamber (200) to the extended floor (230) is smooth.

Looking at the unfolding operation of the eaves (220) and the extended floor (230), the extended floor (230) is provided so as not to block the window (221) on the inside of the eaves (220), and when the eaves (220) are lifted, a ceiling is formed, and the extended floor (230) is unfolded to the outside of the auxiliary chamber (200).

The floor wheel (231) of the extended floor (230) rolls along the floor rail (240) and is pulled out outside and rotates at the end of the floor rail (240) to place the extended floor (230), which is placed in a vertical direction, in a horizontal direction to form a bottom surface.

At this time, the stopper (232) formed on the floor wheel (231) is caught on the stop stand (250) at the end of the floor rail (240) to maintain the extended floor (230) to be placed horizontally and prevent it from leaving the auxiliary chamber (200).

Occupants of the camping space may enjoy camping in the additional space formed by the extended floor (230) and eaves (220).

Figure 11:
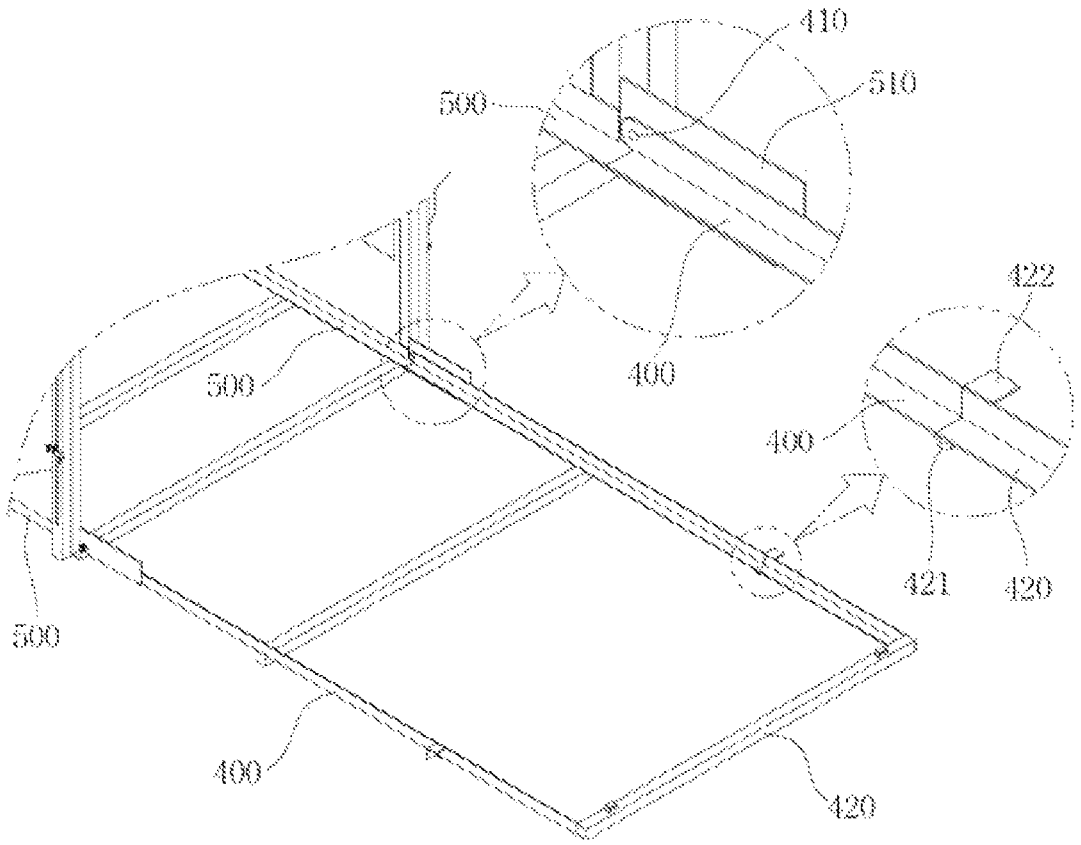
FIG. 11 is a perspective view showing the main support, auxiliary support and extension support according to the multi-stage camping house of the present invention.
Figure 12:
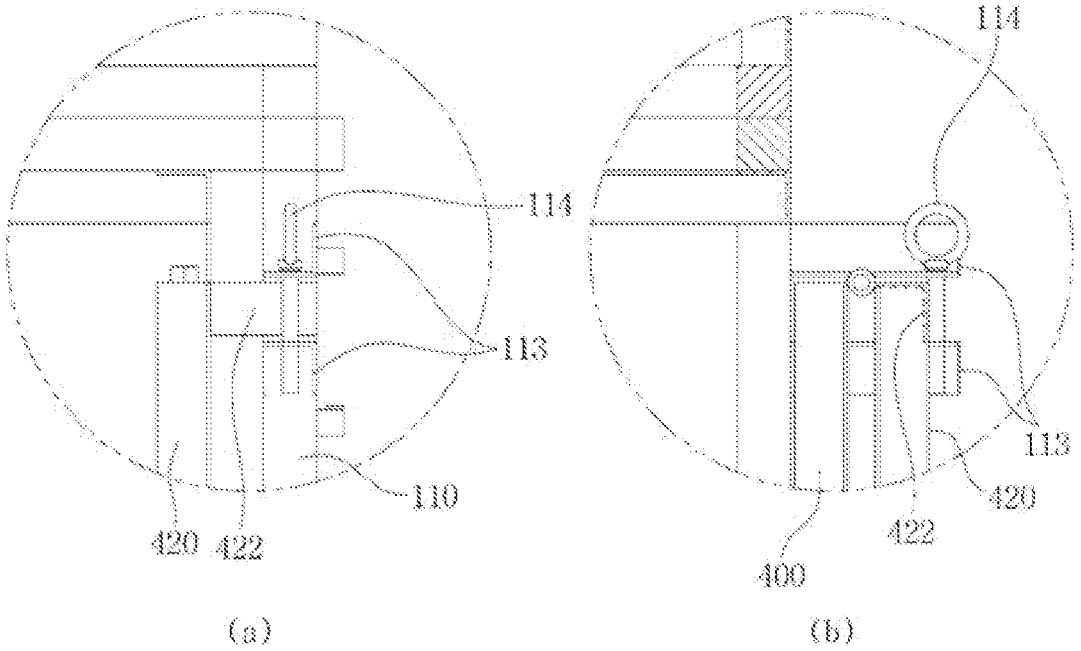
FIG. 12 shows a state in which the fixing protrusion of the extension support according to the multi-stage camping house of the present invention is inserted into the support fixing groove, in which FIG. 12(*a*) is a front view thereof, and FIG. 12(*b*) is a side view thereof.
Figure 13:
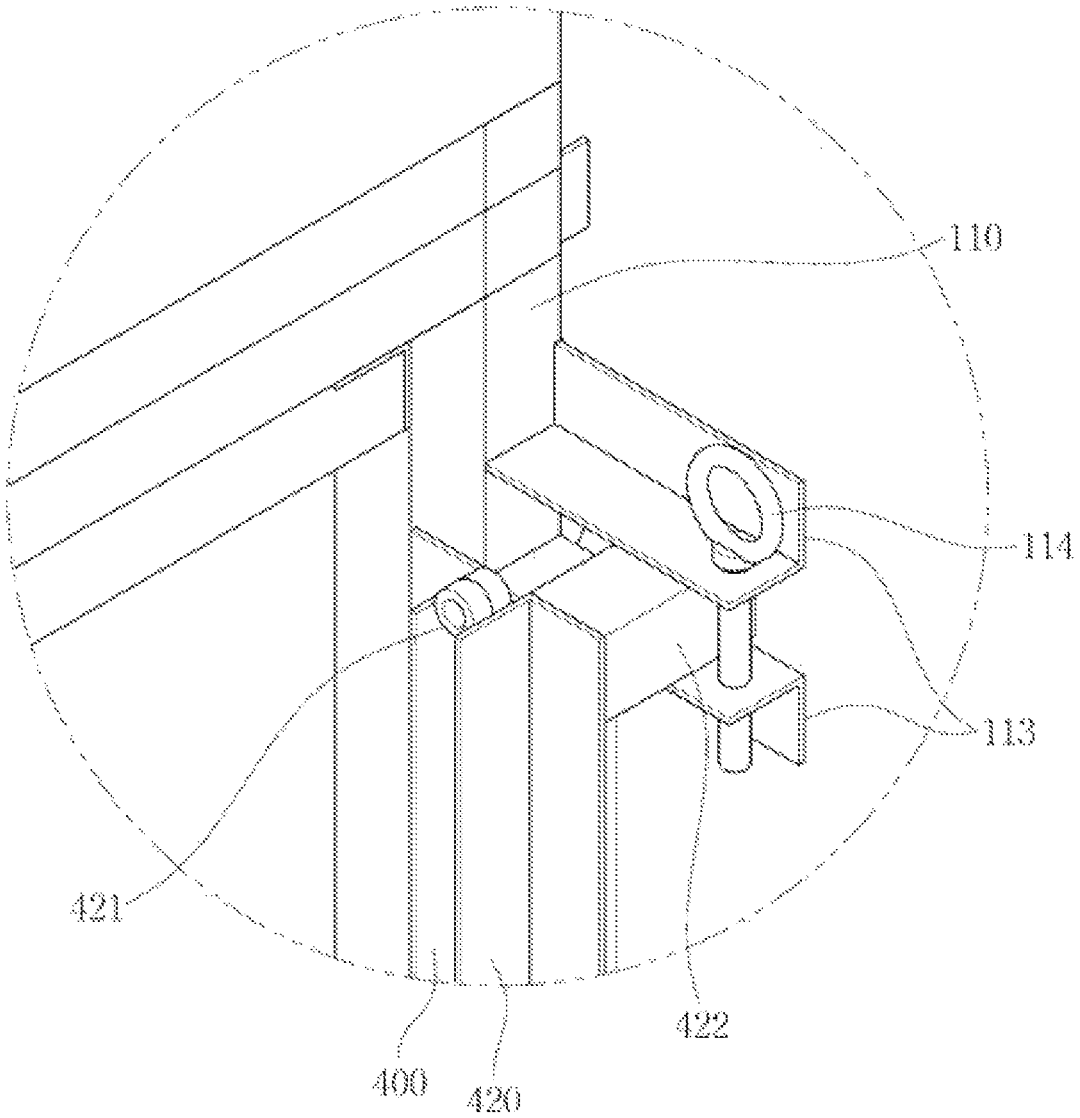
FIG. 13 is a perspective view showing a state in which the fixing protrusion of the extension support according to the multi-stage camping house of the present invention is inserted into the support fixing groove.

As shown in FIGS. 11 to 13, the main chamber (100) and the auxiliary chamber (200) expand the camping space. The main chamber (100) is supported by the main support (500) disposed below, and the auxiliary chamber (200) is supported by the auxiliary support (400).

The fixing column (110) supporting the main chamber (100) is provided on the outside of the main support (500) to support the load, and the main support (500) forms the bottom surface of the main chamber (100).

The auxiliary support (400) is a frame for supporting the auxiliary chamber (200) and is folded and coupled to the main support (500).

A hinge stand (510) is added to the outer surface of the main support (500), and the rotation hinge (410) of the auxiliary support (400) is coupled to the hinge stand (510). Since the hinge stand (510) is provided outside the main support (500), the rotation hinge (410) of the auxiliary support (400) may be located on the same plane as the main support (500), and the rail surfaces of the main support (500) and the auxiliary support (400) are also formed at the same height, so no step occurs. The rail surfaces of the main support (500) and the auxiliary support (400) also form the same plane.

Further, the rotation hinge (410) is formed in a round shape, so that it does not contact the main support (500) when the rotation hinge (410) rotates, enabling smooth operation.

The auxiliary support (400) may be folded vertically or horizontally by the rotation hinge (410). When moving the camping house of the present invention to a camping site, the auxiliary support (400) is folded to minimize the volume, and when installed at a camping site, the auxiliary support (400) is rotated downward and placed horizontally, and the auxiliary chamber (200) is pulled out from inside the main chamber (100) and placed on the auxiliary support (400).

In order to reinforce the length of the auxiliary support (400), an extension support (420) coupled to the auxiliary support (400) by an extension hinge (421) is provided. The extension support (420) is provided with the extension hinge (421) to be folded at the end of the auxiliary support (400) so that the extension support (420) may be folded vertically or horizontally.

When the length of the auxiliary support (400) for supporting the auxiliary chamber (200) is short, the extension support (420) is used to further extend the length. Accordingly, the auxiliary support (400) may have a sufficient length to support the auxiliary chamber (200). Since the auxiliary support (400) is provided to be folded vertically when the camping house is moved, if it is higher than the height of the main chamber (100), movement is inconvenient.

Therefore, the extension support (420) is folded and coupled to the auxiliary support (400), so that the auxiliary support (400) may be formed lower than the height of the main chamber (100), and if the length to support the auxiliary chamber (200) is insufficient, the extension support (420) may be unfolded to reinforce the length.

Further, an extension chamber (not shown) is provided to form a camping space in the internal space and to be additionally drawn out from the inside of the auxiliary chamber (200), so that the camping house of the present invention can be configured in three or more stages, and the extension support (420) may be provided to support the added extension chamber (not shown). In this case, the inner space of the camping house is further expanded, providing leisurely and spacious camping life. With the provision of the extension support (420), the camping house of the present invention may be provided in three or more stages.

A fixing protrusion (422) protruding outward is formed on the extension support (420). When viewed in a vertically folded state, the fixing protrusion (422) is formed on the upper part of the extension support (420) and protrudes in both directions.

The fixing protrusion (422) is a component for fixing the extension support (420) and the auxiliary support (400) in a vertically folded state and is inserted into the support fixing groove (113) formed on the fixing column (110).

The fixing protrusion (422) is inserted between the support fixing grooves (113), and a fixing member (114) such as a bolt is passed through the support fixing groove (113) so that the fixing protrusion (422) does not fall out between the support fixing grooves (113). The fixing protrusion (422) is not separated from the support fixing groove (113) by the fixing member (114).

The fixing protrusion (422) is provided on the extension support (420), and in order to insert the fixing protrusion (422) into the support fixing groove 113, the extension support (420) and the auxiliary support (400) must be in a folded state. Therefore, the auxiliary support (400) and the extension support (420) are fixed in a vertically folded state by the fixing protrusion (422). The auxiliary support (400) is also in a folded state by the fixing protrusion (422) formed on the extension support (420).

The operation of the multi-level camping house of the present invention is described as an example.

The camping house of the present invention moves to the camping site so that the vehicle's loading box is mounted on a moving frame such as a caravan. When moved to the camping site, the auxiliary support (400) and the extension support (420) are in a folded state, and the fixing protrusion (422) is inserted into the support fixing groove (113) and fixed in the folded state.

Further, the auxiliary support (400) is formed to have a length lower than the height of the main chamber (100), thereby reducing the risk of being caught by an obstacle during movement.

When arrived at the camping site and then the camping house of the present invention is installed, the fixing member (114) of the support fixing groove (113) is released, and the auxiliary support (400) and the extension support (420) are unfolded horizontally.

Afterwards, the auxiliary chamber (200) is pulled out from inside the main chamber (100) and placed on the rail surface of the auxiliary support (400), and if the extension chamber (not shown) is additionally provided inside the auxiliary chamber (200), the extension chamber (not shown) is pulled out. At this time, since there is no step between the main support (500) and the auxiliary support (400), the auxiliary chamber (200) may be smoothly pulled out.

The main support (500), the auxiliary support (400), and the extension support (420) support the main chamber (100) and the auxiliary chamber (200) from below.

Campers may enter and exit the internal camping space through the entrance door (150) formed in the main chamber (100) and the auxiliary chamber (200), and ventilation can be achieved by opening all the entrance doors (150) and allowing a headwind to blow.

Further, in the main chamber (100), the elevating column (120) inside a fixing column (110) raises the roof (140) and the space is divided by the layer wall (141) to form an upper space of the attic. The elevating column (120) may be simultaneously raised and lowered by hydraulic pressure. In the case of manual rising and lowering, when the single rotation shaft (300) provided on one side of the main chamber (100) is rotated, the chain (330) engaged with the first sprocket wheel (310) or the second sprocket wheel (320) raises the protrusion (121) of the elevating column (120), thereby lifting the elevating column (120).

All the elevating columns (120) connected to the chain (330) may be raised and lowered simultaneously by the rotation of the single rotation shaft (300).

As the elevating column (120) is raised, the upper and lower elevators are also raised, and the upper elevator (123) passes the central groove (125) of the lower railing (124) and then pushes up the upper rail (126), and subsequently, the lower elevator (122) also raises the lower railing (124). As the spacing between the upper and lower railings widens, a railing is formed in the space above the layer wall (141), thereby preventing occupants from falling.

Further, after the elevating column (120) is raised, the fall prevention bar (112) of the fixing column (110) is locked to prevent the elevating column (120) from falling further, thereby preventing safety accidents.

The eaves (220) forming the side walls of the auxiliary chamber (200) rotate upward to form an additional ceiling, and the extended floor (230) provided inside the eaves (220) also rotates downward to extend the bottom surface.

The extended floor (230) moves and rotates along the floor rail (240), and then the stopper (232) of the floor wheel (231) is caught by the stop stand so that the extended floor (230) is fixed horizontally.

Since the extended floor (230) and the eaves (220) form an additional space communicating with the outside, campers may feel a sense of openness.

DESCRIPTION OF REFERENCE NUMBERS

100: main chamber, 110: fixing column, 111: elevating groove, 112: fall prevention bar,
113: support fixing groove
114: fixing member, 115: idle wheel
120: elevating column, 121: protrusion, 122: lower elevator, 123: upper elevator
124: lower railing, 125: central groove, 126: upper railing 127: stalk
130: bed frame, 140: roof, 141: layer wall, 150: entrance door, 160: outer wall
200: auxiliary chamber, 210: chamber wheel, 220: eaves, 221: window
230: extended floor, 231: floor wheel, 232: stopper, 233: folding plate, 234: floor hinge
240: floor rail, 250: stop stand
300: rotating shaft, 310: first sprocket wheel, 320: second sprocket wheel, 330: chain, 340: chain box
400: auxiliary support, 410: rotation hinge, 420: extension support, 421: extension hinge
422: fixing protrusion
500: main support, 510: hinge stand

The invention claimed is:

1. A multi-stage camping house, comprising:

a main chamber (100) configured to form a camping space in a hollow interior thereof, to be supported by a vertically arranged fixing column (110), to be provided with a roof (140) that is lifted up and down by an elevating column (120) provided inside the fixing column (110) at a upper part thereof, and to be provided with a bed frame (130) that folds vertically or horizontally on both sides thereof; and an auxiliary chamber (200) configured to expand the camping space while being pulled out from the inside to the outside the main chamber (100), to be provided with a hollow interior communicating with an inner space of the main chamber (100) and which is provided with a chamber wheel (210) for movement at a bottom thereof;

wherein the fixing column (110) has a vertical elevating groove (111) and a fall prevention bar (112) that is in contact with a protrusion (121) formed in the lower part of the elevating column (120) and moving up and down along the elevating groove (111) to prevent downward movement of the elevating column (120), wherein an upper railing (126) and a lower railing (124) that slide up and down along the longitudinal direction of the elevating column (120) are provided on the outer surface of the elevating column (120), wherein a plurality of spokes (127) connected to an upper railing (126) and a lower railing (124) provided on another adjacent elevator column (120) are attached to the upper railing (126) and the lower railing (124);

wherein the elevator column (120) is provided and protruded with an upper elevator (123) that contacts the upper railing (126) to raise and lower the upper railing (126), and a lower elevator (122) that contacts the lower railing (124) to raise and lower the lower railing (124), and wherein the lower railing (124) has a space separated for the upper elevator (123) to pass through.

2. The multi-stage camping house of claim 1, comprising: a main support (500) being disposed at the lower part of the main chamber (100), having a rail surface in contact with the chamber wheel (210), being located inside the fixing column (110), and having a hinge (510) coupled to the outer surface of an end thereof; and an auxiliary support (400) supporting the auxiliary chamber (200) from the bottom, having a rail surface in contact with the chamber wheel (210), and having a rotation hinge (410) coupled to rotate on the hinge (510).

3. The multi-stage camping house of claim 2, wherein an extension support (420) supports the auxiliary chamber (200) from below, is folded at the end of the auxiliary support (400) by an extension hinge (421), and has a fixing protrusion (422) protruding outward at a upper part thereof, and the auxiliary support (400), and the extension support (420) are fixed in a vertically folded state while the fixing protrusion (422) is inserted into the support fixing groove (113) formed on the fixing column (110).

4. The multi-stage camping house of claim 2, wherein the rotation hinge (410) of the auxiliary support (400) is formed to be round, and when the auxiliary support (400) is unfolded horizontally, a rail surface of the main support (500) and a rail surface of the auxiliary support (400) are formed at the same height.

5. The multi-stage camping house of claim 1, wherein the auxiliary chamber (200) has an extended floor (230) that extends to the outside of the auxiliary chamber (200) to form a bottom surface and is provided on the inside of the eaves (220) forming a side wall of the auxiliary chamber (200), and wherein the extended floor (230) includes a floor wheel (231) that rolls on a floor rail (240) formed in the lower part of the auxiliary chamber (200); and a folding plate (233) that is folded and connected to the extended floor (230) by a floor hinge (234) to form a bottom surface.

6. The multi-stage camping house of claim 5, wherein a stopper (232) formed on the floor wheel (231) is hung on a stop stand (250) formed higher than the height of the floor rail (240) so that the extended floor (230) is fixed in the unfolded state.

7. The multi-stage camping house of claim 6, wherein a bottom surface of the extended floor (230) in the unfolded state is formed at the same height as a bottom surface of the auxiliary chamber (200), and the height when the folding plate (233) and the extended floor (230) are folded is lower than the height of a window (221) provided in the eaves (220).

8. The multi-stage camping house of claim 1, wherein the main chamber (100) is provided with a single rotating shaft (300) on one side, in which a pair of first sprocket wheels (310) arranged in a horizontal direction are formed and a pair of second sprocket wheels (320) are formed outside the first sprocket wheels (310), and wherein a protrusion (121) on which a chain (330) engaged with the first sprocket wheels (310) or the second sprocket wheels (320) is fixed is formed at a lower part of the elevating column (120).

9. The multi-stage camping house of claim 1, wherein the plurality of spokes (127) respectively attached to the upper railing (126) and the lower railing (124) are arranged vertically.

10. The multi-stage camping house of claim 8, wherein a gap between the upper rail (126) and the lower rail (124) becomes the same as a gap between the upper elevator (123) and the lower elevator (122) when the elevatoring column (120) rises.

* * * * *